US005127212A

United States Patent [19]

Johnsen et al.

[11] Patent Number: 5,127,212

[45] Date of Patent: Jul. 7, 1992

[54] BALER WITH ADJUSTABLE CHUTE

[75] Inventors: Hugo Johnsen; Ole Johnsen, both of Campbellville, Canada

[73] Assignee: Johnsen Machine Company Ltd., Ontario, Canada

[21] Appl. No.: 707,291

[22] Filed: May 30, 1991

Related U.S. Application Data

[63] Continuation of Ser. No. 520,325, May 7, 1990, abandoned.

[30] Foreign Application Priority Data

May 8, 1989 [CA] Canada ..... 598931

[51] Int. Cl.[5] ..... B65B 35/50

[52] U.S. Cl. ..... 53/540; 53/535; 193/2 C

[58] Field of Search ..... 53/245, 498, 501, 535, 53/540, 570, 571, 572, 255, 257, 260, 261, 447; 193/2 C, 2 D; 414/900

[56] References Cited

U.S. PATENT DOCUMENTS

| | | | |
|---|---|---|---|
| 231,215 | 8/1880 | Dederick | 53/261 X |
| 1,794,517 | 3/1931 | Hellman | 53/245 X |
| 2,597,364 | 5/1952 | Nash | 53/261 |
| 3,619,968 | 11/1971 | Kapare | 53/447 X |
| 3,641,735 | 2/1972 | Daily et al. | 53/540 X |
| 3,698,153 | 10/1972 | Lieberman | 53/260 X |
| 3,927,508 | 12/1975 | Campbell, III | 53/540 X |
| 4,045,940 | 9/1977 | White et al. | 53/540 X |
| 4,054,015 | 10/1977 | Rowell | 53/540 X |
| 4,099,607 | 7/1978 | Brennan et al. | 193/2 C |
| 4,172,349 | 10/1979 | Lipes | 53/572 X |
| 4,586,315 | 5/1986 | Wolf | 53/245 X |
| 4,679,379 | 7/1987 | Cassoli | 53/447 X |
| 4,788,812 | 12/1988 | Morita et al. | 53/447 |
| 4,798,042 | 1/1989 | Davis | 53/572 |

*Primary Examiner*—Robert L. Spruill
*Assistant Examiner*—Daniel B. Moon
*Attorney, Agent, or Firm*—Rogers & Scott

[57] ABSTRACT

The invention provides a high speed baling machine having a multi part chute which can be adjusted horizontally in both width and depth to accommodate packages of various lengths and widths with the packages falling sidways in the chute.

10 Claims, 10 Drawing Sheets

BALER WITH ADJUSTABLE CHUTE

This application is a Continuation of application Ser. No. 07/520,325, filed May 7, 1990 now abandoned.

BACKGROUND OF THE INVENTION

This invention relates to baling machines which load packages of goods into bale bags and to a high speed baling machine which is easily adjustable to put different sizes of packages into a corresponding one of a range of sizes of bale bags. More particularly the invention provides a chute and a bale bag supply apparatus both of which can be adjusted to accept the packages and bale bags.

The invention will be explained with reference to baling packages of potatoes but it is also suitable for baling other types of bagged products, such as ice and more particularly fruits and vegetables.

Many types of packaged products are sold in relatively small packages, such as for example potatoes which are commonly sold in packages of 5 or 10 pounds and ice which is commonly sold in 10 pound packages. Handling and shipping products in units of such a small size increases costs and so it is common to package or bale a number of smaller packages of product into a bale bag which contains between 40 and 60 pounds of product in order to minimize handling costs.

Baling can be done by hand but automated baling machines or balers are quite often used to decrease labour costs and increase baling speeds Typically such balers elevate the packages lengthwise on a conveyor belt before unloading them sequentially sideways into a vertical chute until a group of a predetermined number are stacked side-by-side on trap doors at the bottom of the chute. The doors are then opened and the group of packages in the chute drop into an open bale bag suspended below the chute. One improvement to such a baler is to include a moveable platform below the chute, arranged such that the platform moves to absorb the impact as the packages drop into the bale bag thereby minimizing possible damage to the products in the packages. Next the full bale bag is pushed onto a conveyor and the upper end of the bag is straightened by a bag conditioner and closed by an automatic tying machine as the bag exits the baler.

Empty and closed bale bags are suspended from a bag supply apparatus which is fixed to accept one size of bale bag top although the apparatus may be adjusted to accept bale bags of different lengths.

Adjustment of the chute in this baler is possible in a limited fashion to accommodate different lengths of packages as they fall sideways. The chute is made up of two flat side portions and two curved end portions which are bolted to the baler's frame. The chute can be adjusted to accommodate a range of package lengths by varying the distance between the end portions. Such an adjustable chute is provided to suit a small range of similar packages which vary somewhat in length rather than in width. In practice, however, the limitations of such a machine result in compromises to extend the range of sizes of packages which can be baled. For instance, it is possible to arrange smaller packages in an average bale bag by dropping the packages so that every other one touches one end portion and the adjacent ones touch the other end portion. The result is an interweaving of the packages to make as much use as possible of a bale bag and chute shaped for larger packages. Clearly the inherent limitations of such prior art balers restricts the application of the balers to those packages for which the baler is designed. It would therefore be advantageous if a baler could be adjusted to receive a wide variety of packages and to place them in bale bags designed specifically for those packages. The resulting full bale bag would be better for handling and there would be a minimum of wastage.

SUMMARY OF THE INVENTION

It is an object of the present invention to provide a high speed baling machine which can be quickly adjusted to accept bale bags with different sizes of mouth to match different sizes of packages of product.

Accordingly, in one aspect the invention provides a high speed baling machine having a multi part chute which can be adjusted horizontally in both width and depth to accommodate packages of various lengths with the packages falling sideways in the chute.

In another aspect, the invention provides a bale bag supply apparatus for use with the chute to present bale bags of a suitable size for each of the sizes of packages.

DESCRIPTION OF THE PREFERRED EMBODIMENT

Construction and operation of the invention will now be explained with reference to a preferred embodiment of the invention as it would be typically used to bale five pound packages of potatoes into bale bags measuring 20 ins. by 35 ins. when folded flat.

Figure 1:
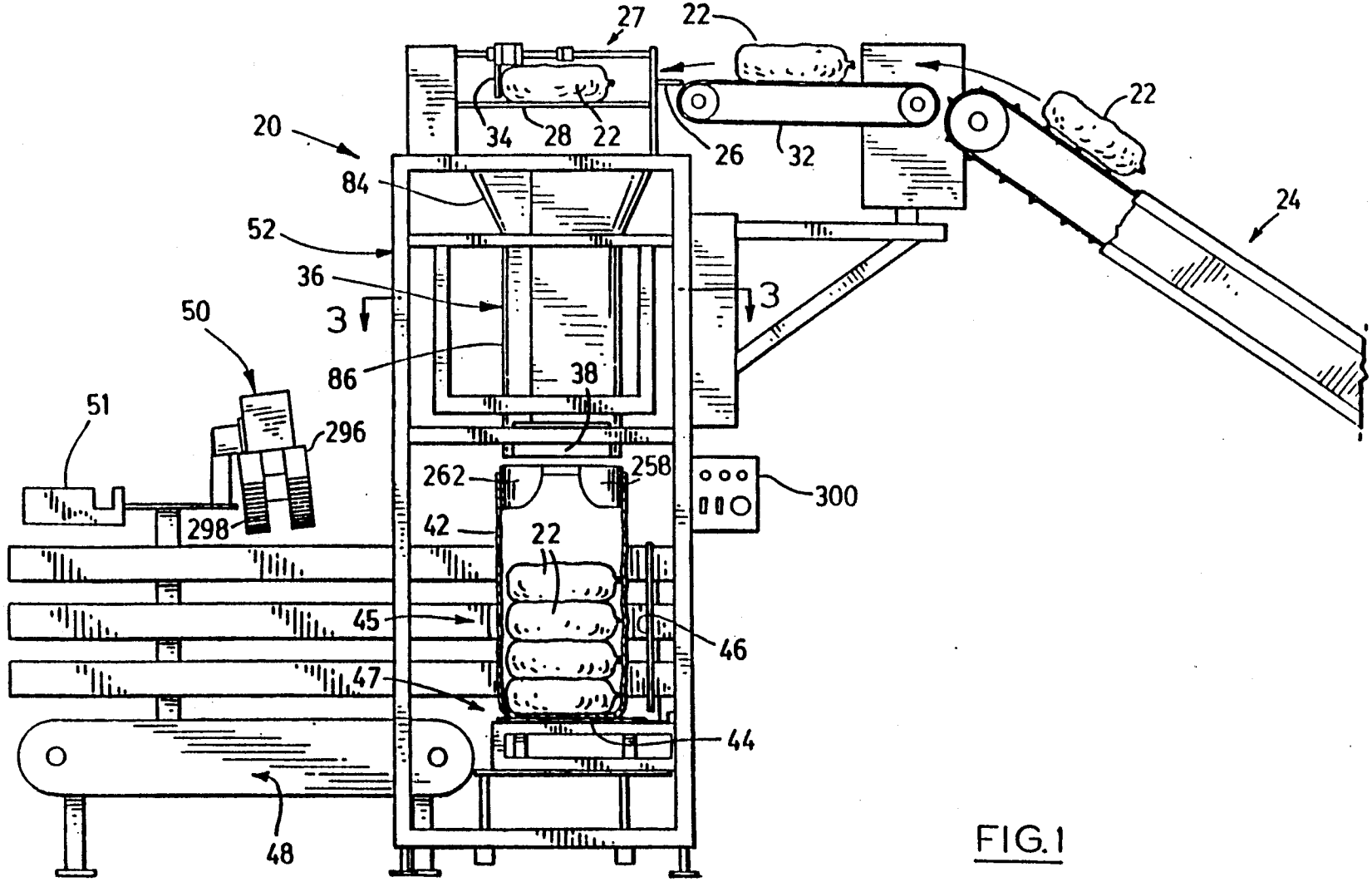
FIG. 1 is a front elevational view of a preferred embodiment of a baling machine according to the invention, and shown in operation baling packages of potatoes which enter by a conveyor into an entrance side of the machine, fall into a chute, and leave at the bottom on the exit side of the machine in a bale bag.

FIG. 1 illustrates a baling machine designated generally by the numeral 20. Packages of potatoes 22 enter the baling machine 20 lengthwise on an elevating conveyor 24. Upon reaching the top, a package is accelerated by an intermediate conveyor 32 and projected across a connecting plate 26 into a loading station 27 where the package rests on a pair of upper trap doors 28, 30 (visible in FIG. 2). The packages come to rest against an adjustable stop plate 34 before being dropped sequentially and sideways into a chute 36 by opening the upper trap doors. When the selected number of packages 22 have accumulated as a group in the chute 36 supported on a pair of lower trap doors 38, 40 (not visible in FIG. 1 but shown in later views), the lower trap doors are opened and the packages drop in unison into an open bale bag 42 held beneath the chute. The free fall of the packages is checked by engagement with a platform 44 located beneath the bale bag and driven to move downwards with the packages and to then decelerate the packages and thereby minimize impacts as the packages reach their destinations in the bale bag, and come to rest in a bag loading station 45. Next a pusher plate 46 forming part of a transport mechanism 47 moves the loaded bale bag 42 horizontally onto an exit conveyor 48, which also forms part of the mechanism 47. On the journey along the exit conveyor the top of the bag is driven upwards by a bag conditioner 50 and secured closed by a conventional bag tying machine 51.

Support for the elements of the baling machine is provided by a rigid frame 52 having vertical uprights connected one to another by horizontal cross members.

Figure 2:
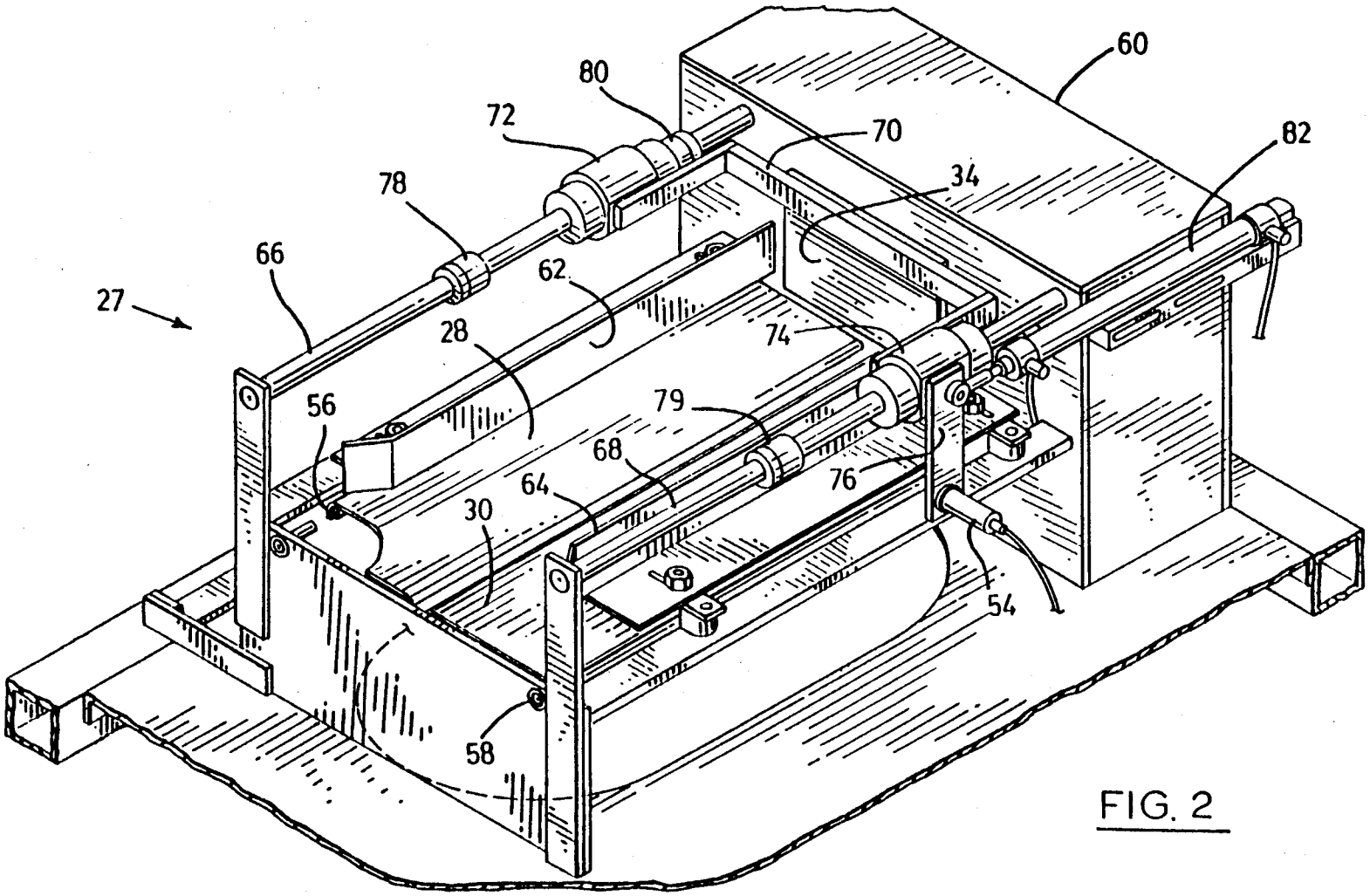
FIG. 2 is an isometric view of an upper part of the machine (drawn to a larger scale) and showing details of a stop plate used to locate the packages and trap doors used to receive the packages and drop them sequentially.

Reference is now made to FIGS. 1 and 2. As packages 22 reach the end of the elevating conveyor 24, the packages pass one at a time onto the intermediate conveyor 32 which projects them over the connecting plate 26 and onto the closed upper trap doors 28, 30, stopping in engagement with the vertical stop plate 34. A sensor 54 (visible in FIG. 2) which is located to one side of the stop plate 34 senses the presence of a package when it takes up position at the stop plate and initiates opening of the upper trap doors 28, 30 to drop the package into the chute 36 located below the doors. The spacing between packages on the conveyor 24 is such that the trap doors 28, 30 can return to the closed position after dropping a package and before the next package arrives.

In FIG. 2 it can be seen that the upper trap doors pivot on upper door pivots 56, 58 which run parallel to sides of the chute. (For convenience this spacing will be referred to as the depth of the chute since it extends rearwardly from the front of the machine. The measurement at right angles to the depth is the width of the chute.) The doors are actuated by an electric motor gear combination located inside a housing 60 which sits behind the stop plate 34 and guide fences 62, 64 are located on either side of the trap doors 28 and 30 to locate the packages over the doors.

The stop plate 34 is positioned across the rear end of the upper trap doors and is movably attached to a pair of stop plate guide rods 66, 68 extending above and to either side of the chute 36, by a support 70 extending between the guide rods and attached to the top of the stop plate 34. The support 70 is fixed at its ends to bearing assemblies 72, 74 on the guide rods 66, 68 respectively. The bag sensor 54 is secured below the rear bearing support 74 by a bracket 76 so that it moves with the stop plate.

The assembly consisting of the stop plate 34, support 70, bearing assemblies 72, 74 and bag sensor 54 can be moved linearly along the stop plate guide rods 66, 68 into a position defined by two adjustable bearing stops 78, 79 located on the entrance side of the assembly, one on each of the stop plate guide rods. A third bearing stop 80 is located on the guide rod 66 to define a range of motion of the stop plate assembly. However this range is used only as a secondary feature as will be described. In the preferred form of use, the stops 78, 79 are set to correspond to the sizes of the packages so that when a package is located by the stop plate, the package is centered over the chute. This will become more apparent as the description evolves. The assembly is moved into position and held there by a pneumatically operated actuator 82 which is anchored on the near side of the housing 60 and is attached at its other end to the bracket 76 to move the stop plate assembly between a first position in engagement with the stops 78 and a second position in engagement with the stop 80.

As mentioned previously, the packages fall downwards into the chute 36. In FIG. 1 it can be seen that the chute 36 comprises a tapered upper portion 84 which converges downwardly to funnel packages dropped by the upper trap doors 28, 30 into a tubular lower portion 86 where product bags accumulate in a side-by-side stack or group before being dropped into the bale bag 42

Figure 3:
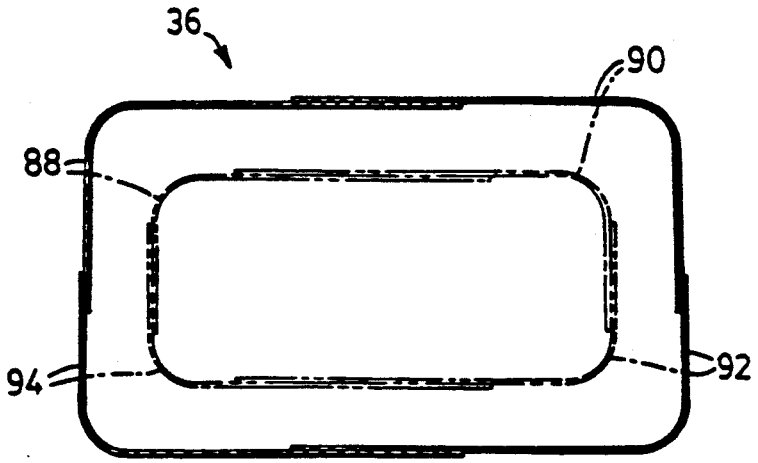
FIG. 3 is a cross-sectional view along line 3—3 of FIG. 1 (drawn to a larger scale) and showing only the chute opened to its largest size in solid outline and with the smallest size in ghost outline.

The tubular chute is generally rectangular in horizontal cross-section with rounded corners as best seen in FIG. 3. It is constructed from four similar overlapping sheet metal corner sections 88, 90, 92, 94. Each section includes part of both the tapered upper portion 84 and the tubular lower portion 86 as can be seen in the isometric view, FIG. 4 as well as generally coplaner flanges 96, 98, 100, 102 forming parts of the respective corner sections.

Figure 9:
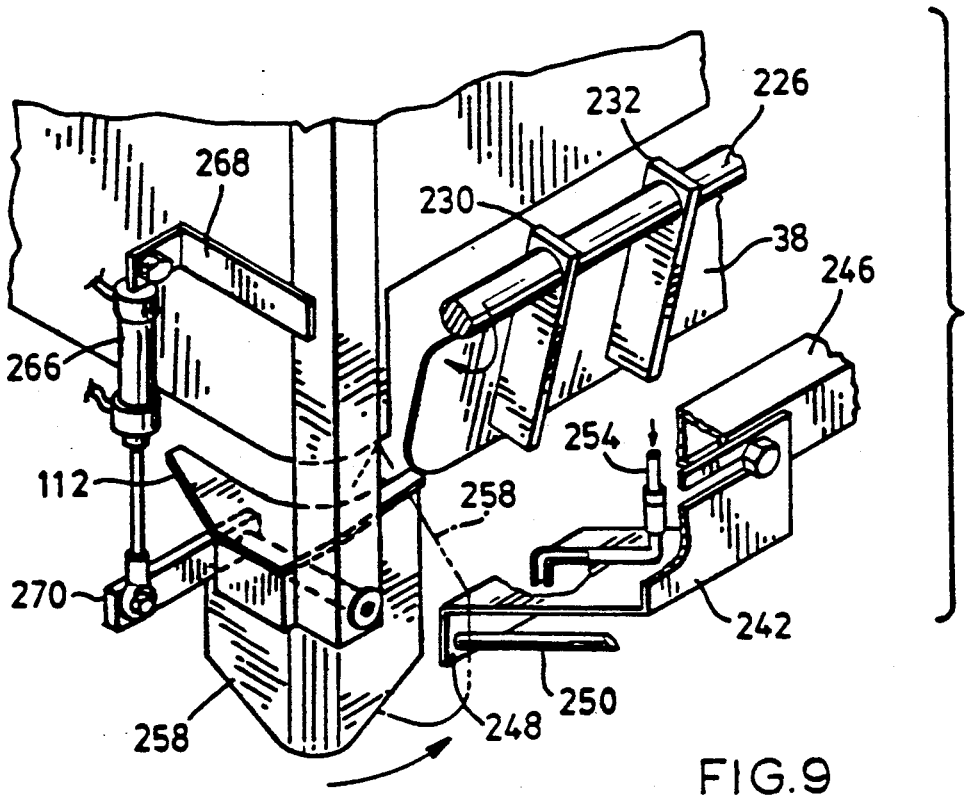
FIG. 9 (drawn adjacent to FIG. 3) is a perspective view of the embodiment of a portion of the machine and showing details of the construction of a lower trap door and a bale bag location shoe.

In FIG. 3 the chute is shown collapsed to its smallest size in ghost outline and expanded as large as it will go in solid outline. The width (i.e. the height of FIG. 3) is adjustable from 6 ins. to 10½ ins. and depth from 10 ins. to 15 ins. measured inside the tubular portion. Depth and width adjustments can be made separately and the chute expands about a fixed central point so that it remains in alignment with other parts of the machine to ensure that the packages always travel along the same path. The lower edge of the chute is shaped on the front and back to form cut-outs 104 (one of which is seen in FIG. 4) thereby providing clearance for the lower trap doors as seen in FIG. 9.

Figure 4:
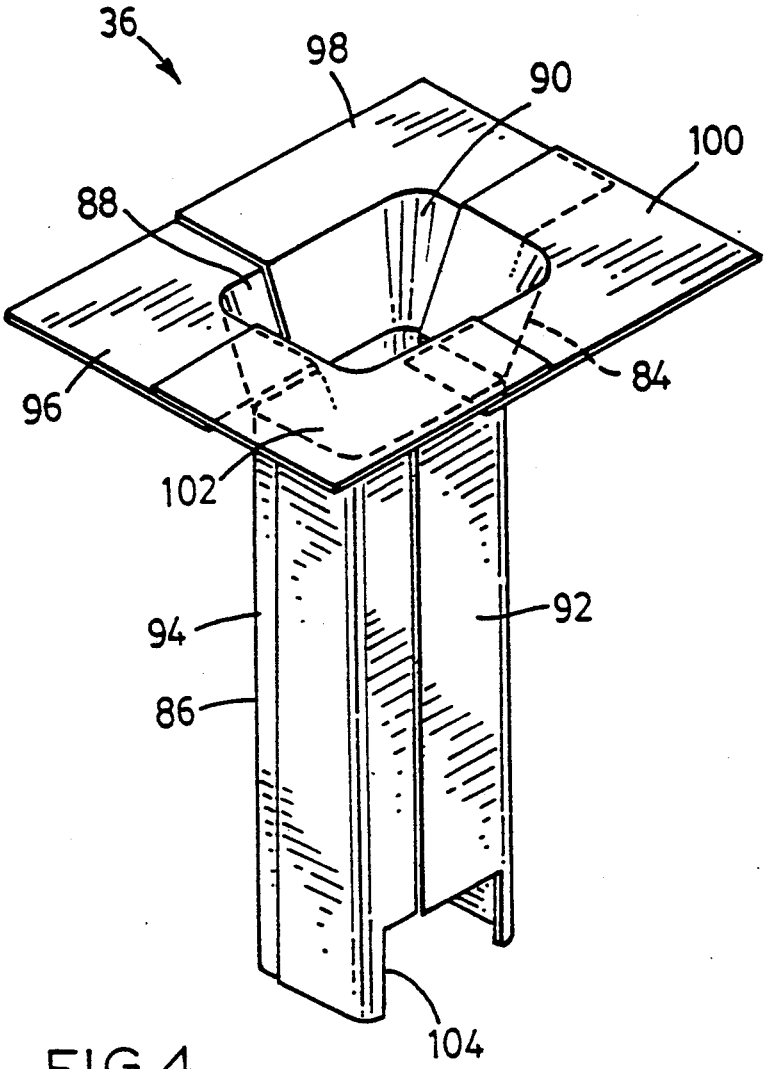
FIG. 4 is an isometric view of the chute.
Figure 5:
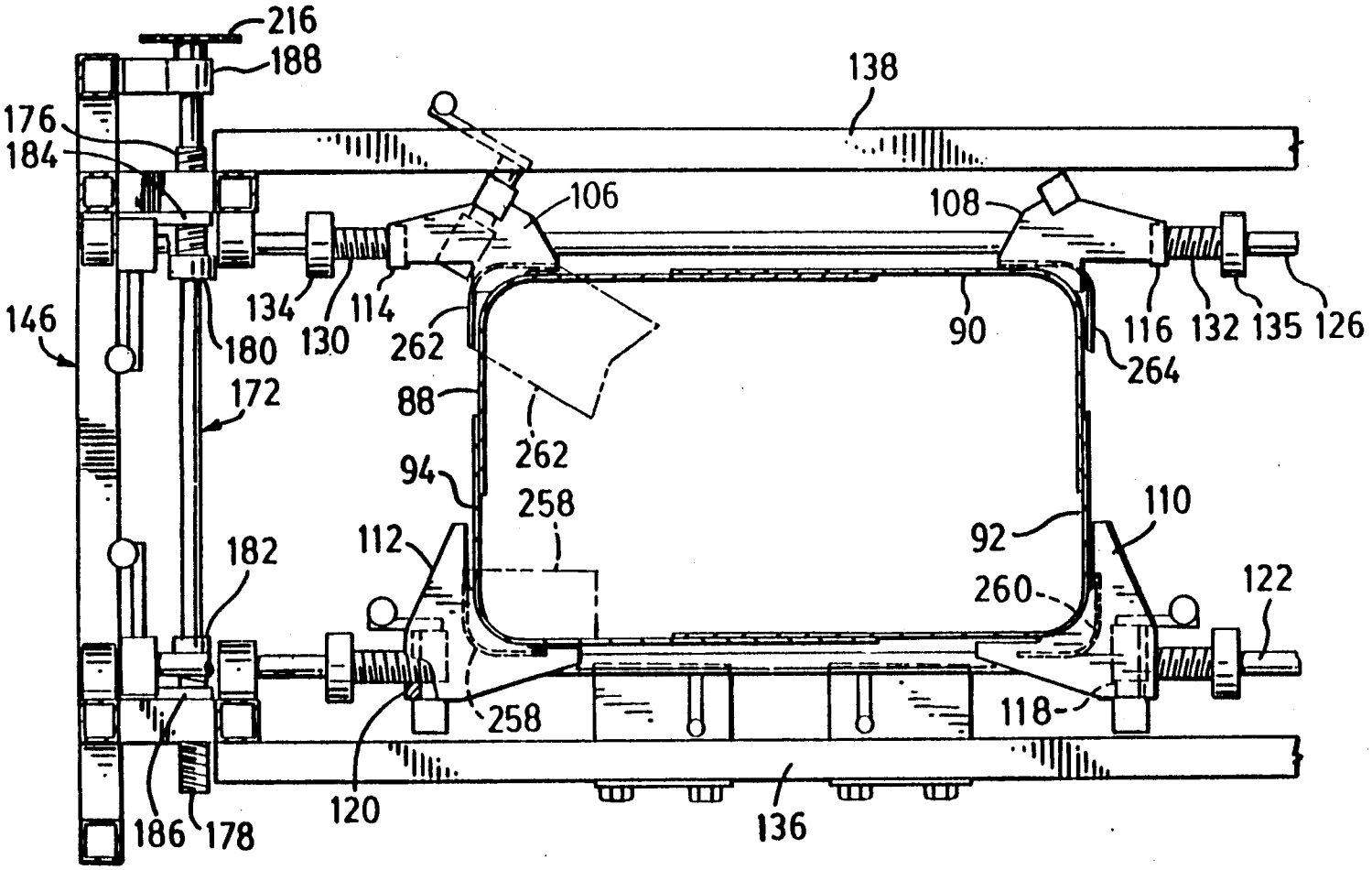
FIG. 5 is a partial cross-sectional view also on line 3—3 of FIG. 1 and showing the chute in one position together with details of the chute mounting and adjusting mechanism.

As seen in FIG. 4, the chute has generally coplaner flanges 96, 98, 100, 102 on the respective corner sections and as seen in FIG. 5, the corner sections are attached to respective lower brackets 106, 108, 110, 112. Similar upper brackets are also attached but are not seen in the drawings. However the location of the upper brackets will become evident when the method of adjustment is explained. Each of the eight corner support brackets is in turn fixed to a threaded block. Four lower threaded blocks 114, 116, 118, 120 are visible beneath the lower corner support brackets in FIG. 5.

Figure 8:
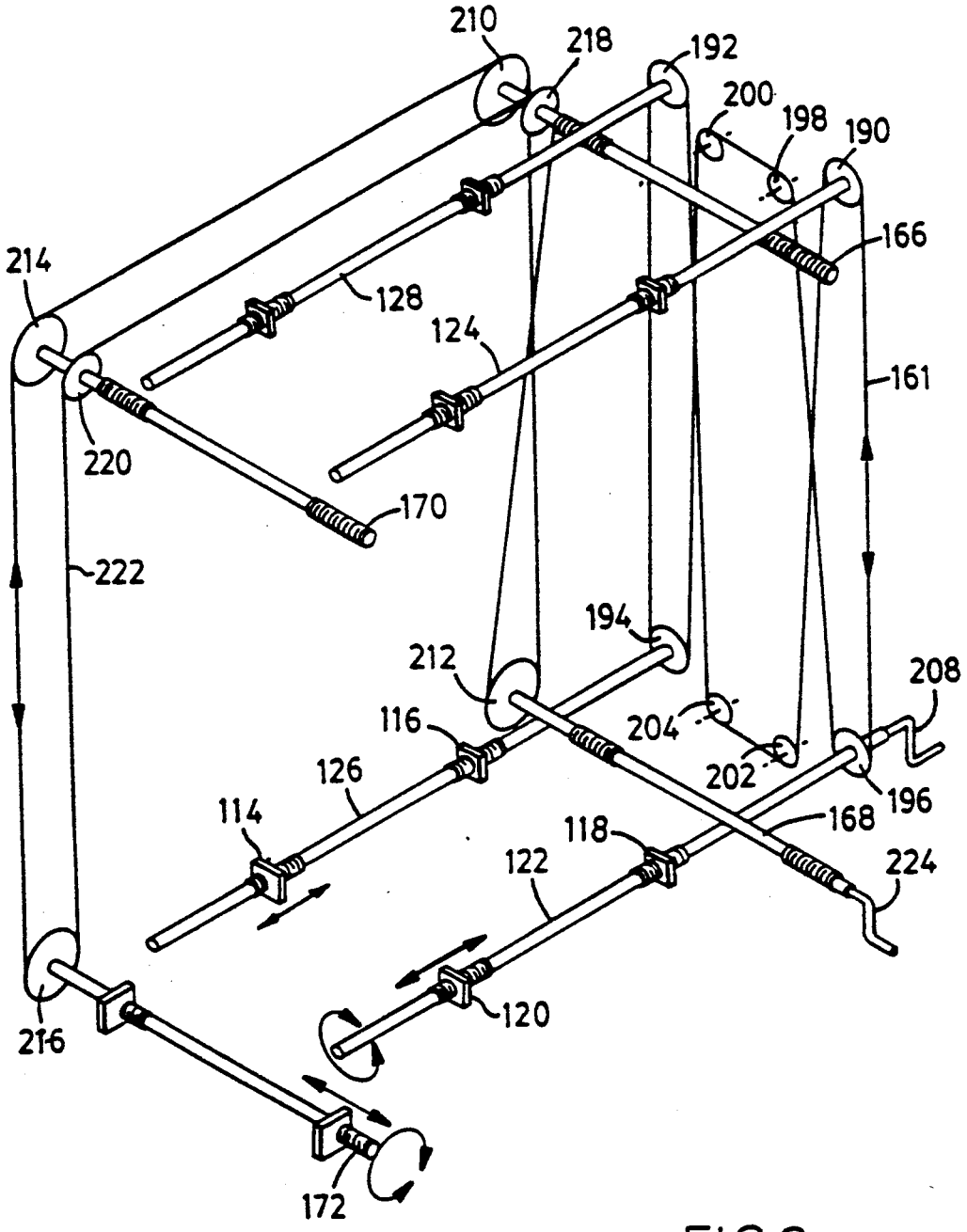
FIG. 8 is a schematic perspective view of the driven elements of the adjusting mechanism.

Four horizontal adjustment rods 122, 124, 126, 128 (see FIG. 8) are provided with threaded portions upon which the threaded blocks are mounted to adjust the width of the chute. All four rods are similar therefore construction of only the lower rear adjustment rod 126 will be explained in detail. The rod 126 is made up of a plain round bar to which two threaded sleeves 130, 132 of opposite hand are attached at collars 134, 135. The sleeves are threaded to match the respective lower rear threaded blocks 114, 116 into which they are threaded. Turning the rod 126 in a first direction slides the lower portions of the chute corner sections 88 and 90 equal distances in opposite directions to open up the chute, and turning the rod in the other direction closes the chute. Referring briefly to FIG. 8, it will be seen that upper rear adjustment rods 126 and 128 are provided for moving the upper portions of the rear chute corner sections, and rods 122 and 124 for moving the front chute corner sections. In practice the four adjustment rods are rotated in unison by a chain drive as will be explained in more detail later with further reference to FIG. 8.

Referring again to FIG. 5, the pairs of front and rear adjustment rods 122, 126 are supported for independent movement on front and rear moveable frames 136, 138 which allow the rods to move towards and away from one another. Because the sliding frames are similar, construction and mounting of only the front sliding frame will be described with reference to FIGS. 5, 6 and 7. The sub-frame 136 is made up of uprights joined by a number of horizonal members. The upper and lower front adjustment rods are rotatably secured adjacent their ends to the sub-frame 136 in respective pairs of bearing blocks 140, 142.

Support for the moveable frame 136 is provided b respective entrance and exit side frame supports 144, 146 bolted in place to the entrance and exit sides of the rigid frame 52 between respective upper and middle horizontal members. Each of the frame supports includes a rectangular portion having a pair of vertical projections at its upper and lower ends to locate the rectangular portion in position in the frame 52. The outer parallel uprights of the sliding frame are slidably supported between horizontal portions of the frame supports.

Figure 7:
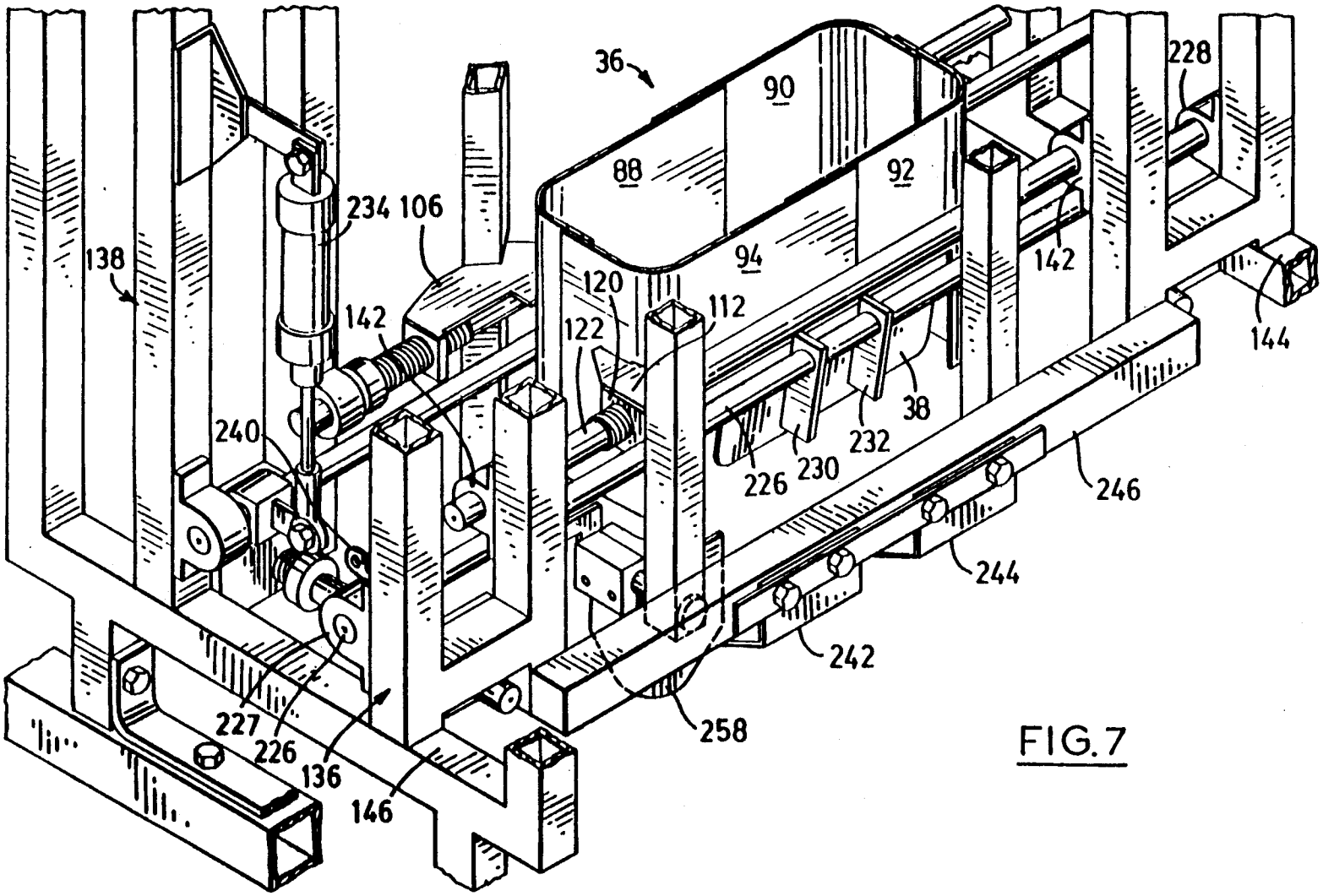
FIG. 7 is a cutaway perspective view of the machine and showing further details of the chute adjusting mechanism.

As seen in FIG. 8, depth adjustment of the chute is controlled by four adjustment rods 166, 168, 170, 172. Because all four rods are similar, construction of only the lower exit side adjustment rod 172 will be explained in detail. Referring to FIG. 5 the rod 172 is constructed from a plain round bar with two threaded sleeves 176, 178 of opposite hand attached to the rod at collars 180, 182. The depth adjustment rods run horizontally between adjacent corners of the front and rear moveable frames 136, 138 and are secured to the frames by threaded brackets, exemplary brackets 184, 186 being seen in FIG. 5 holding rod 172. The threaded brackets also keep the moveable frames 136, 138 centered in the sliding frame supports 144, 146 as can be seen in FIG. 7. The depth adjustment rod 172 extends rearwardly from the rear sliding frame 138 and is rotatably secured with an attachment bracket 188 (visible in FIG. 5) to frame support 146 to control movement of the rod. As with the width adjustment rods, there is a chain drive, (seen in FIG. 8) which can be used to rotate these width adjustment rods in unison to adjust the chute depth. (i.e. front and back measurement).

Reference is now made to FIG. 8 to describe the moving parts of the chute adjustment mechanism. The front adjustment rods 122, 124 are located in fixed relation to one another on the front moveable frame and the rear adjustment rods 126, 128 are located in a similar manner on the rear moveable frame. Consequently the distance between the front and rear frames changes with changes in the distance between the front and rear length adjustment rods as the chute is adjusted. This causes a difficulty in that the horizontal spacing between the parallel rods varies and a single drive system is needed for adjustment To solve this, a drive system with eight sprockets and a continuous chain is used. Four drive sprockets 190, 192, 194, 196 are mounted at the respective entrance ends of the width adjustment rods with all of the drive sprockets positioned to rotate in a common first plane. There are also four idler sprockets mounted in a second plane parallel to the first and offset towards the exit end of the baler sufficient to prevent interferences between overlapping chain runs. One pair of idler sprockets 198, 200 is located at the same height as the upper drive sprockets 190, 192 between the upper adjustment rods 124, 128 and the remaining sprockets 202, 204 are located between the lower length adjustment rods level with the lower drive sprockets 194, 196. All four idler sprockets are mounted on the rigid frame 52.

A resulting drive chain 206 is in the form of a continuous loop and traces a path from the front of the lower front drive sprocket 196 over the top of the upper front drive sprocket 190 then down underneath both lower idler sprockets 202, 204, proceeding from front to back. Next the chain loops over the upper rear drive sprocket 192 and then down to the lower rear drive sprocket 194. From there it loops over the upper idle sprockets 200, 198 from back to front and ends back at the lower front drive sprocket 196. Consequently, the sprockets move in unison to drive the rods 122, 124, 126 and 128 in directions which cause width adjustment of the chute. To this end a simple hand crank 208 is added to the end of rod 122.

Each width adjustment rod can be moved sideways over a 4.5 inch range and this is permitted because the chain runs are not affected significantly by the movement. Consequently no matter what movement takes place, the chain remains in driving contact with the sprockets.

Moving now to the depth adjustment chain drive, it should be noted the width adjustment rods used for this have a spacing which remains constant thereby allowing a much simpler drive to be used. Once again each of the rods is provided with a respective one of four drive sprockets 210, 212, 214, and 216 and two idler sprockets 218, 220 are also provided, one rotating on each of the upper depth adjustment rods. A continuous chain 222 is wrapped clockwise (as seen in FIG. 8) from the lower exit side drive sprocket 216 over the upper drive sprockets 214, 210 and then down to the lower entrance drive sprocket 212 before returning in a counter-clockwise direction over the idler sprockets 218, 220 to the lower exit side drive sprocket 216. A crank handle 224 is attached to the lower entrance side depth adjustment rod 168 to turn all four of the rods in unison to adjust the chute depth.

As a result of this structure the chute can be adjusted for width and depth evenly about a fixed vertical central axis.

The construction of the lower trap door will now be explained with reference to FIGS. 6, 7 and 9. It will be noted that the lower trap doors 38, 40 sit in the cut-outs 104 in the chute 36 when in an engaged position to hold packages in the chute. To provide the correct placement, the front and rear lower trap doors are hinged about pivot rods connected to the front and rear sliding frames respectively so that the trap doors move with these panels. This allows the pivot points to move as the chute width is adjusted. Because the trap doors are similar, construction of only the front trap door will be described. A front pivot rod 226 is rotatably secured at its ends to uprights on pillow bearings 227, 228 on the rear sides of the uprights. The rear pivot rod is secured to the front of the rear moveable frame in a similar fashion.

The front lower trap door 38 is fixed to a pair of door support levers 230, 232 which are mounted to the front pivot rod 226. The trap door is bolted to the levers and can be replaced by appropriately sized doors whenever the chute size is varied.

Figure 6:
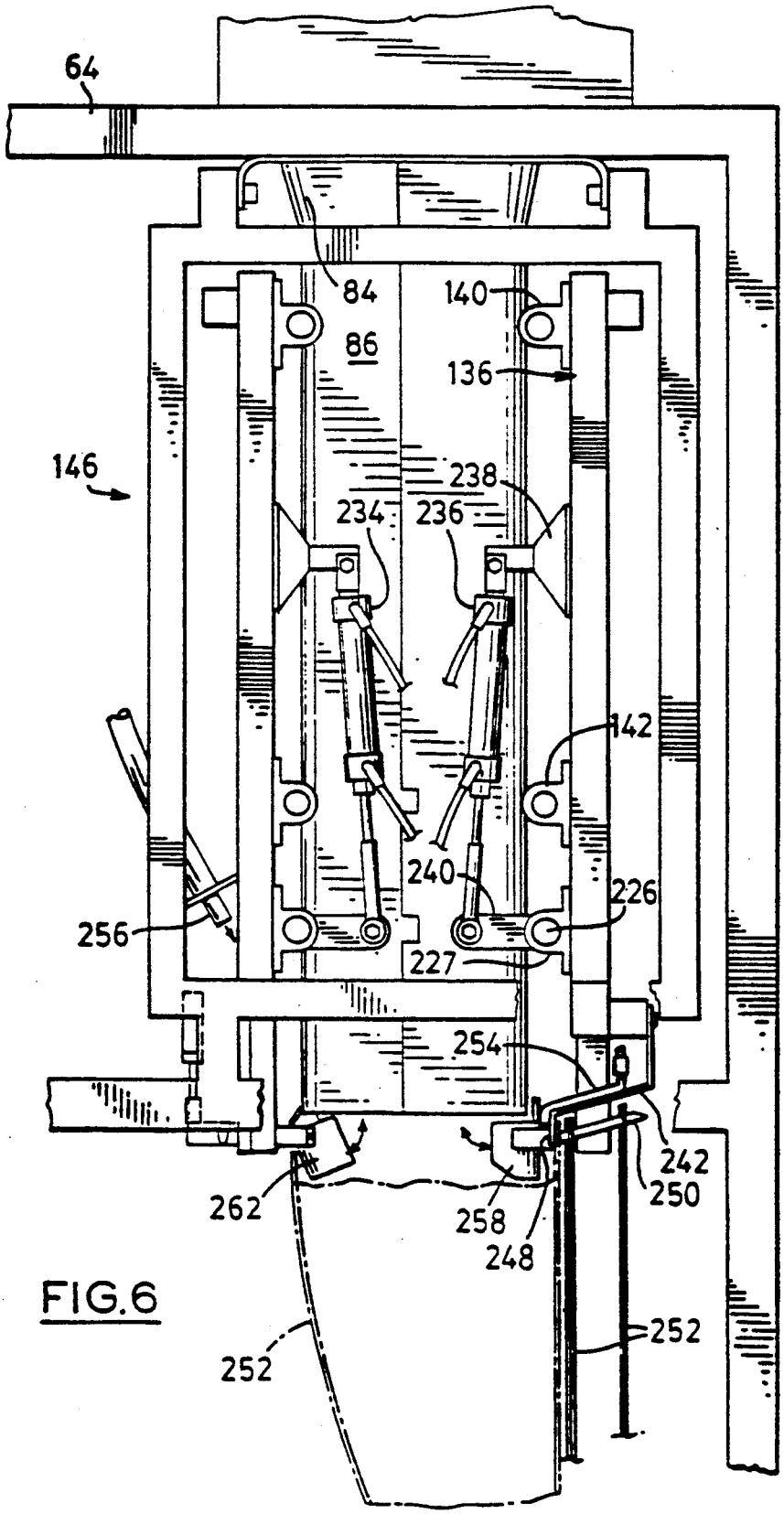
FIG. 6 is a partial end view of the machine and illustrating parts of the chute and bale bag supply apparatus.

Actuation of the doors is accomplished by a pair of double acting pneumatic actuators 234, 236 as seen in FIG. 6. Discussing the front actuator 236, it is anchored at its upper end to the front sliding frame above pivot rod 226 by an actuator support 238 and at its lower end to an actuator lever 240 which pivots with the pivot rod. The rear actuator 234 is mounted to control the rear lower trap door in similar fashion.

Construction of the bale bag supply apparatus located beneath the chute will now be discussed. The apparatus consists of two parts: firstly, there is a bag blowing system which uses jets of air to blow bale bags open beneath the chute one at a time; and secondly there is a bag holding system which consists of four bag location shoes which engage with the inside of a bale bag to hold it in place beneath the chute once it has been opened by the air flow. These doors also act to funnel falling packages into the open bale bag.

The bag blowing system will be explained first. At the entry side of the baler there are provided two bag support brackets 242, 244 (visible in FIGS. 6 and 7) which are bolted to a lower horizontal frame member 246 which runs between the front inner sliding frame uprights. The brackets 242, 244 project downwardly to the rear ending in a downwardly projecting vertical portion 248 adjacent the front edge of the chute. The brackets are provided with one of a pair of support pins 250 (one of which is seen) fixed to the vertical portions of the brackets and inclined outwardly and upwardly.

Bale bags 252 are supplied flat with the upper edge of one side cut below the other and crimped so that the bag is easily opened. The cut side is exposed in front of the uncut side which is provided with two holes to receive the support pins 250. As the bags closest to the chute are used up, the remaining bags slide down the inclined pins into place adjacent the chute. The bag support bracket spacing can be adjusted on the lower horizontal frame member 246 to accommodate bale bags having different hole spacings.

A pair of air supply tubes 254 (one of which is seen in FIG. 9) end at the rear of the support brackets 242, 244 to initiate opening of the next bale bag hanging on the brackets. Once partially opened, a further three air supply tubes 256 (one of which is seen in FIG. 6 located behind the chute on the rear sliding frame) complete opening of the bag.

Once a bag has been opened, it must be located in place ready to receive packages from the chute. This is done by a bag location mechanism (not numbered) and including the four bag location shoes 258, 260, 262, 264 (FIG. 5). Each of the shoes is shaped to fit into the bag and create a corner in the mouth of the bale bag. The shoes are moveable from an upper or disengaged position where the shoes are above the entry plane of a new bag, and a lower or engaged position where the shoes are aligned downwardly with the bag to hold the mouth of the bag open. An exemplary shoe 258 is seen in this position in FIG. 9. Once a bale bag has been filled the shoes are pivotted upwards back into their disengaged positions.

The shoes are suspended from respective uprights and move in unison with the associated one of the chute corner sections when chute size is adjusted. As a result the shoes are always in position to engage the bale bag. The four uprights are fixed one to each set of chute corner support brackets and project down below the lower edge of the chute. The front pair of shoes 258, 260 pivot about horizontal axes running rearwardly from front uprights and act to pull the trailing part of a bale bag mouth into place. The rear shoes 262, 264 are pivoted about horizontal axes which are rotated outwardly approximately 30 degrees from the front axes along with the door uprights as seen in FIG. 5. This angle allows the rear bag holding shoes to pivot inwards and forwards when disengaged so that as they move into the engagement positions, these shoes tend to catch a rear part of the mouth of an open bale bag even though it may not have been fully opened by the air supply tubes.

In FIG. 5 rear bag holding shoe 262 is shown disengaged, in chain dotted outline thereby demonstrating how the angle of the axis of rotation allows the door to pivot from this position outwardly and rearwardly to catch the mouth of the bale bag. Construction of the bale bag holding system in this manner allows it to be adjusted automatically as the chute is adjusted.

The bag holding shoes are operated by individual double acting pneumatic actuators 266 one of which is seen in FIG. 9. The actuator 266 is attached at its upper end to a support 268 fixed to an upright and operates a crank 270 fixed to the shoe pivot for rotating the shoe between engaged and disengaged positions.

Once the bale bag is in position it is ready to catch a falling stack of packages on the platform 44. The pusher plate 46, which can be seen from the front in FIG. 1, and in perspective in FIG. 10 is then used to push the full bag onto the exit conveyor 48.

Figure 10:
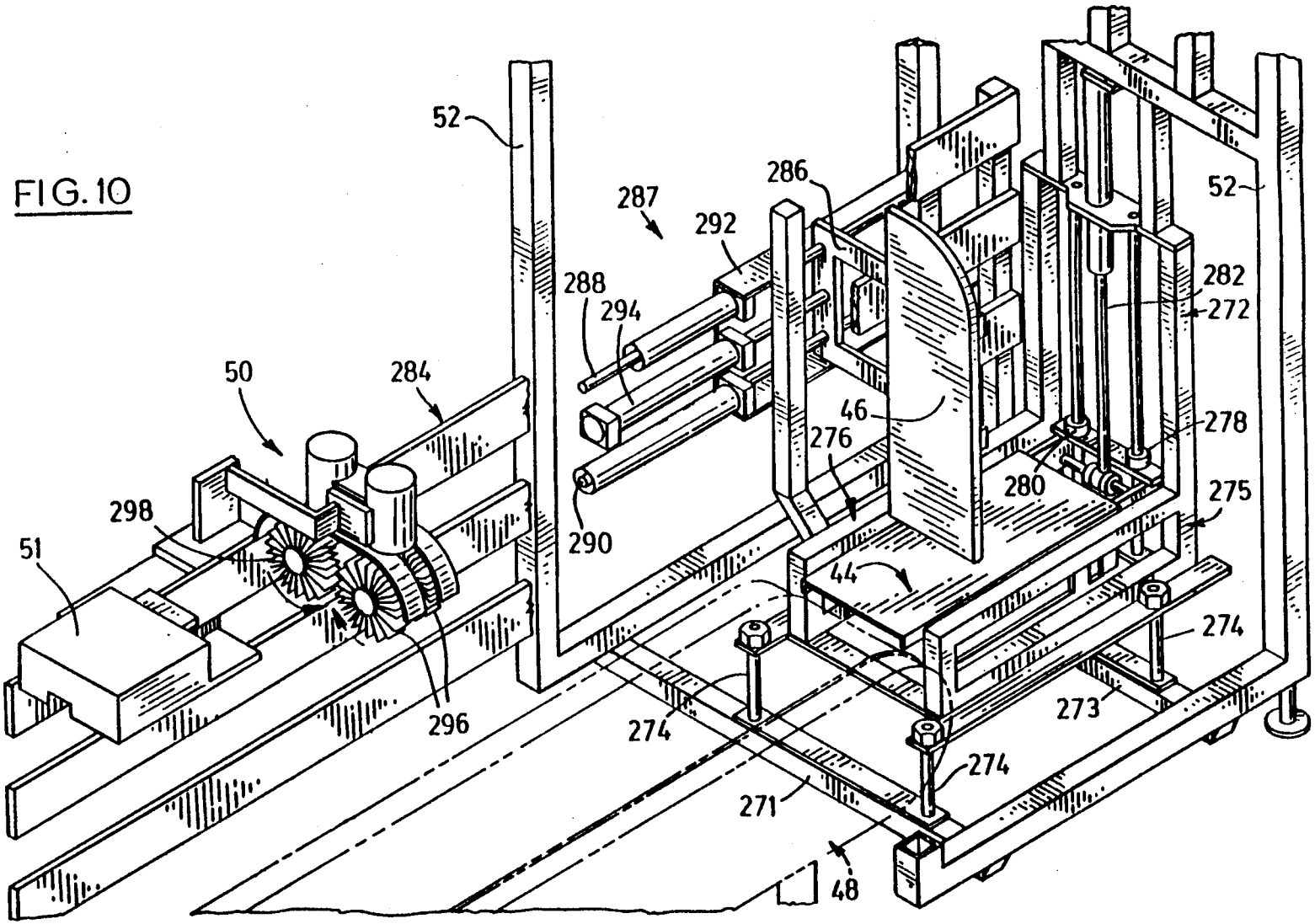
FIG. 10 is a perspective view of the machine looking from the front and showing details of a moving platform, pusher plate, exit conveyor and bag conditioner.

As seen in FIG. 10, the moving platform, pusher plate and their operating mechanisms are mounted on a sub-frame 272 which is supported on lower support frame cross members 271, 273 by four adjustable pillars 274 (three of which can be seen in FIG. 10). The sub-frame 272, pusher plate 46 and moving platform 44 can be removed from the baling machine as a unit for replacement with other types of bag off-loading equipment or possibly for use on another type of baling machine.

The moving platform 44 moves in a vertical direction and is designed to engage with falling packages as they drop from the chute, and to gradually bring them to a halt to minimize impacts and thereby limit bruising. In its lowered position the platform is between two end frames 275, 276 and front and rear platform guide rods extend vertically in parallel and are fastened between cross members of the sub-frame 272. Platform guide bearings 278, 280 run on the guide rods as the platform moves vertically between the lowered position shown in FIG. 10 and a raised position ready to move downwardly with the falling packages.

The platform is moved by operation of a pneumatic actuator 282 which is secured to the rigid frame 52 and to the platform 44. As the bag leaves the platform 44, it engages the exit conveyor 48 which is preferably tilted by a small angle towards a bag support fence 284 provided to support the full bale bag as the bag is transported horizontally. The tilting is achieved by moving the entire sub-frame 272 using the adjustable pillars 274.

As also seen in FIG. 10, pusher plate 46 is carried by a frame 286 forming part of a pusher plate support structure 287 located behind the bag support fence 284. This structure includes two horizontal guide rods 288 and 290 which slide in bearings provided in a support 292. The support 292 is secured to verticals in the frame 52 and the frame 286 which supports the pusher plate 46 is attached to the guide rods 288, 290. An actuator 294 is attached to the support 292 and coupled to the frame for moving the pusher plate 46 between a withdrawn position ready to move the bale bag and an extended position where the pusher plate has moved the bag onto the conveyor 48. In FIG. 10 the plate 46 is in an intermediate position.

As seen in FIG. 1, once they are filled, the bale bags leave the bagging machine on exit conveyor 48 and reach the bag conditioner 50 at its entrance side and the bag tying machine 51 at its exit side.

The bag conditioner 50 comprises two pairs of driven vaned wheels 296, 298. Each of the wheels consists of a solid hub to which is fixed a plurality of flat flexible vanes which inspire air flow to deflect the bag upwardly ready for the bag tying machine 51.

Figure 11:
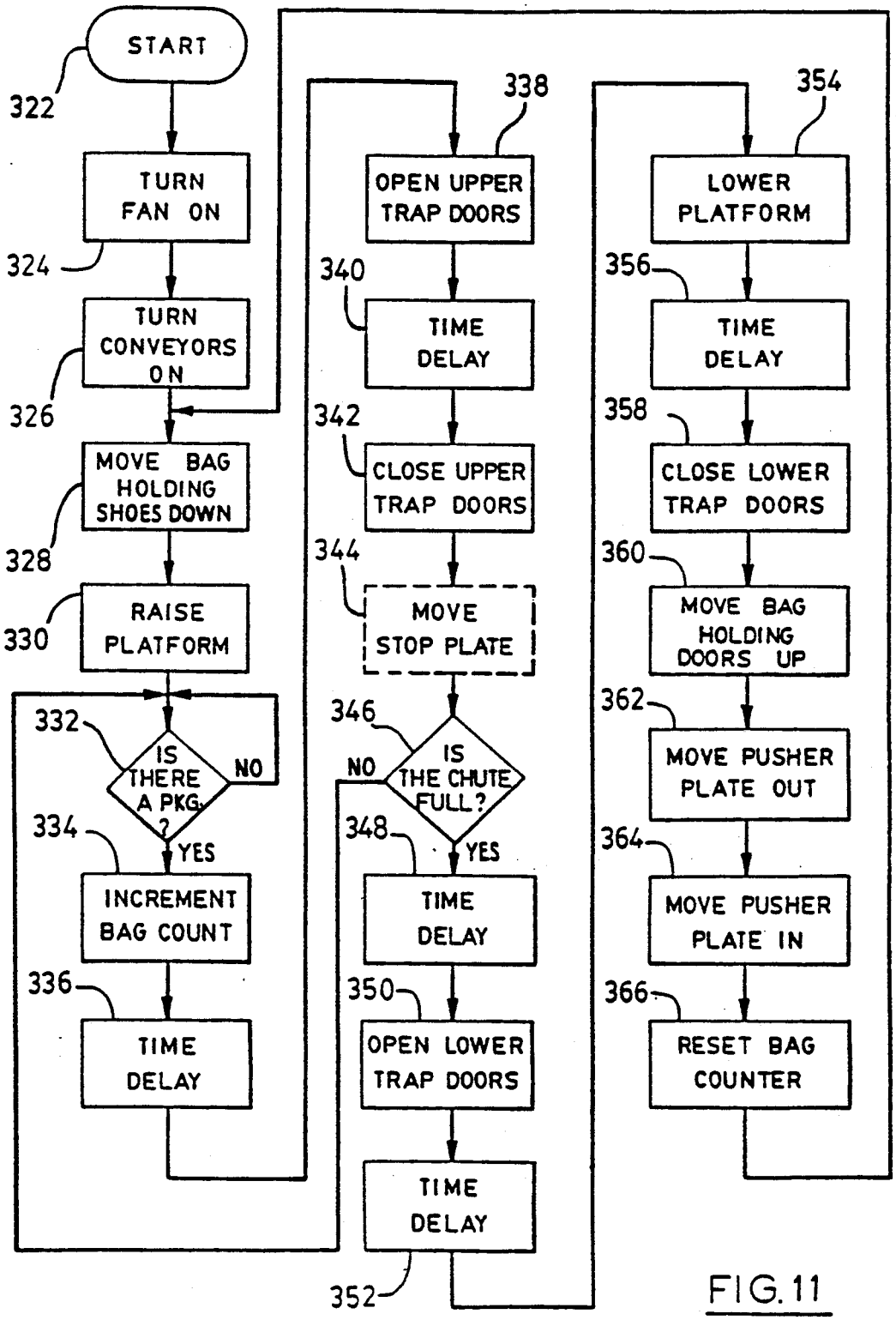
FIG. 11 is a flow chart describing the operation of the baling machine.

The baler is controlled by a control system shown schematically as 300 in FIG. 1. This system operates the baler in accordance with the flow chart shown in FIG. 11. As stated previously the preferred embodiment is designed to be adjusted to packages of a selected size into a corresponding sized bale bag. Of course smaller packages can always be placed in larger bale bags. If this is necessary, a system is provided to maximize the use of the bale bags by staggering ot interleaving the packages in the bale bag as will be described.

In a preferred mode packages are collected in bale bags with a mouth size equivalent to the side profile of the package. The process for this type of baling begins at 322 of FIG. 11. At 324 a fan is turned on to blow air into a bale bag 42 which is to open beneath the chute 36 in the manner already described. Next conveyor belts 24, 32 and 48 are turned on at 326 in preparation for receiving product bags. Once these actions have been executed, the baler loops continuously through the flow chart performing the functions 328 to 366 except for 344 which is not executed for this type of baling.

Proceeding to 328 in FIG. 10, the baler lowers the bag holding shoes to grip the mouth of the bale bag 42. Next at 330 the moving platform 44 is raised ready to receive a falling stack of packages. A determination is then made at 332, as to whether a package is in place on the upper trap doors 28 and 30, (FIG. 2) the answer being provided by bag sensor 54. When there is no package present at the upper trap doors, the control system will cycle repetitively through 332 until a bag is sensed whereupon the count of bags in the chute 36 will be incremented at 334. Next there will be a small time delay as shown at 336 to ensure that the sensed package has hit the stop plate 34 and come to rest before the upper trap doors 28 and 30 are opened at 338 followed by a short time delay at 340 to ensure that the package which has been dropped into the chute 36 is clear of the upper trap doors before they are closed at 342.

Action 344 is in ghost outline to indicate that this action is not executed when baling into bale bags with a mouth size which is equivalent to the side profile of the package. In this case the stop plate is positioned over the exit side of the chute and does not need to move after each product bag is dropped into the chute At 346 the bag count is checked to determine if the chute contains enough packages to fill a bale bag. If not, the system will loop back to 332 to accumulate an additional package otherwise it will proceed to 348.

There is a time delay at 348 to allow the last bag dropped by the upper trap doors 28 and 30 to come to a rest in the bale bag before the lower trap doors 38 and 40 are opened at 350 and the stack of accumulated product bags allowed to drop into the open bale bag 42.

After a short time delay the moving platform 44 is set in motion as indicated at 354. Timing of the platform drop is important because it must be moving downwards as the stack of product bags hits it to minimize product damage.

There is another short time delay at 356 to allow the stack of product bags to clear the chute 36 before the lower trap doors 38 and 40 are closed at 358. At 360 the bag location shoes 258, 260 are pivoted up to clear the now full bale bag 42. At 362 the pusher plate 46 is extended to slide the bale bag 42 onto the exit conveyor 48 and at 364 the pusher plate is retracted. Finally, the bag counter is reset at 366 because the chute 36 is now empty. After 366 the control system loops back to the 328 to begin accumulating product bags in the chute once again.

As mentioned previously, smaller packages can be baled into larger bale bags and arranged in a staggered stack to better fill the bale bag. In this mode the baler also operates in accordance with the flowchart shown in FIG. 11 except that action 344 is included At this point in the cycle, the stop plate is moved so that smaller packages end up stacked in the bale bag 42 with only a partial overlap. In other words a first bag may stop at the plate in a first position against bearing stops 78 and the next bag would hit the plate with the plate located at bearing stop 79. This cycle is repeated so that the packages end up in the chute (and hence in the bale bag) with the packages in a staggered stack.

The bag conditioner 50 operates continuously when the baler is running.

After running the machine to bale a particular size of package, it may be necessary to reset the machine for a different package size and for a different bale bag size Firstly a bale bag size is chosen having a mouth size large enough to accept the package as it falls sideways Once this is done, the bale bag support brackets 242, 244 (FIG. 7) are adjusted with reference to the centre line of the chute to accommodate the selected bale bags.

Next the width and depth of the chute must be adjusted to receive packages in sliding engagement and so that the bag holding shoes are spaced correctly to meet the bale bag and fix the portion of the mouth of the bag. It should be noted that the chute width and depth can be adjusted independently.

After this is done, the bearing stops 78, 79 must be set so that the stop plate will halt the package in the required position above the chute and the control system must be taught how many packages are to be contained in each of the bale bags. The machine is then ready to commence baling.

The embodiments described in this specification are exemplary and descriptive of other embodiments encompassed by the scope of the claims.

The embodiments of the invention in which an exclusive property or privilege is claimed are defined as follows:

1. A machine for baling packages of products, the machine comprising:

an elevator for moving packages sequentially;

a loading station receiving elevated packages from the elevator one at a time, the station having upper trap doors on which each package rests, the trap doors being operable to drop each package individually;

an adjustable chute positioned under the trap doors, the chute being adjustable to change the width and depth dimensions of the chute and the chute including four overlapping sheet metal corner sections;

a chute adjustment mechanism coupled to the chute corner sections and operable to change said dimensions with reference to a fixed central axis of the chute;

said chute adjustment mechanism comprising two upper and two lower rotatable width adjustment rods;

one of said upper width adjustment rods being in threaded engagement with means carried by upper portions of two adjacent corner sections whereby rotation of said one upper width adjustment rod causes width adjusting movement of said corner sections, and the other of said upper width adjustment rods being in threaded engagement with means carried by upper portions of the other two adjacent corner sections whereby rotation of said other upper width adjustment rod causes width adjusting movement of said other corner sections;

one of said lower width adjustment rods being in threaded engagement with means carried by lower portions of said two adjacent corner portions whereby rotation of said one lower width adjustment rod causes width adjusting movement of said corner sections, and the other of said lower width adjustment rods being in threaded engagement with means carried by lower portions of said other two adjacent corner sections whereby rotation of said other lower width adjustment rod causes width adjusting movement of said other corner sections;

means for simultaneously rotating said upper and lower width adjustment rods to adjust the width of said chute;

said adjustment means also comprising two upper and two lower rotatable front to rear depth adjustment rods;

one of said upper depth adjustment rods being in threaded engagement with means carried by the two upper width adjustment rods on one side of the chute whereby rotation of said one upper depth adjustment rod causes depth adjusting movement of the upper width adjustment rods, and the other of said upper depth adjustment rods being in threaded engagement with means carried by the two upper width adjustment rods on the opposite side of the chute whereby rotation of said other upper depth adjustment rod causes depth adjusting movement of the upper width adjustment rods;

one of said lower depth adjustment rods being in threaded engagement with means carried by the two lower width adjustment rods on one side of the chute whereby rotation of said one lower depth adjustment rod causes depth adjusting movement of the lower width adjustment rods, and the other of said lower depth adjustment rods being in threaded engagement with means carried by the two lower width adjustment rods on the other side of the chute whereby rotation of said other lower depth adjustment rod causes depth adjusting movement of the lower width adjustment rods;

means for simultaneously rotating said upper and lower depth adjustment rods to adjust the depth of the chute;

lower trap doors under the chute for assembling a group of packages in the chute as individual packages are received in the chute from a loading station and operable to drop the group of packages; and a bag loading station under the chute, the bag loading station receiving a group of packages in a bale bag.

2. A machine as claimed in claim 1 wherein the means for simultaneously rotating said upper and lower width adjustment rods comprises pulley means on each rod and an endless driving member passing around each pulley means.

3. A machine as claimed in claim 1 in which the four corner sections are similar in shape.

4. A machine as claimed in claim 1 in which the corner sections combine to form a tapered upper portion of the chute to better facilitate entry of a falling package.

5. A machine as claimed in claim 1 and further comprising a transport mechanism operable to move full bale bags horizontally out of the bag loading station.

6. A machine as claimed in claim 5 and further comprising a bag conditioner for driving the mouth of the bag upwardly in a closed position as the bag travels on the transport mechanism, and a bag closing machine for closing the mouth of the bag.

7. A machine as claimed in claim 1 in which the loading station includes a stop plate for engagement by a package to locate the package over the upper trap doors, the stop plate being adjustable for various package sizes to ensure that individual packages are positioned for falling into the chute in a predetermined position relative to said fixed central axis.

8. A machine as claimed in claim 1 in which the bag loading station includes a bag supply apparatus.

9. A machine as claimed in claim 8 in which the bag supply apparatus includes a bag blowing system to open the bag and a bag holding system to retain the open bag in position while the group of packages falls into the bag.

10. A machine as claimed in claim 11 and further comprising a platform moveable between lowered and raised positions, the platform being in contact with a bag when the platform is in the raised position and operable to move downwardly to the lowered position as the group of packages falls so that the group meets the bottom of the bag supported by the moving platform to thereby decelerate the group and minimize damage caused by impact.

* * * * *